US011286740B2

(12) United States Patent
Nault et al.

(10) Patent No.: US 11,286,740 B2
(45) Date of Patent: Mar. 29, 2022

(54) BLOWOUT PREVENTER SHEARING RAM

(71) Applicant: Cameron International Corporation, Houston, TX (US)

(72) Inventors: Christopher Nault, Houston, TX (US); Micah Threadgill, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/854,314

(22) Filed: Apr. 21, 2020

(65) Prior Publication Data

US 2020/0332617 A1 Oct. 22, 2020

Related U.S. Application Data

(60) Provisional application No. 62/836,696, filed on Apr. 21, 2019.

(51) Int. Cl.
*E21B 33/06* (2006.01)
*E21B 33/064* (2006.01)

(52) U.S. Cl.
CPC ..... *E21B 33/063* (2013.01); *E21B 33/062* (2013.01); *E21B 33/064* (2013.01)

(58) Field of Classification Search
CPC ..... E21B 33/063; E21B 33/062; E21B 29/04
See application file for complete search history.

(56) References Cited

U.S. PATENT DOCUMENTS

| | | | | |
|---|---|---|---|---|
| 998,400 | A * | 7/1911 | Ruth | E21B 33/062 251/1.3 |
| 2,090,206 | A * | 8/1937 | King | E21B 33/062 277/325 |
| 3,561,526 | A * | 2/1971 | Williams, Jr. | E21B 29/08 166/55 |
| 3,692,316 | A * | 9/1972 | Bishop | E21B 33/062 277/325 |
| 4,132,265 | A | 1/1979 | Williams, Jr. | |
| 4,132,267 | A * | 1/1979 | Jones | E21B 33/063 166/55 |
| 4,537,250 | A | 8/1985 | Troxell, Jr. | |
| 6,173,770 | B1 | 1/2001 | Morrill | |
| 7,207,382 | B2 | 4/2007 | Schaeper | |
| 7,354,026 | B2 | 4/2008 | Urrutia | |

(Continued)

FOREIGN PATENT DOCUMENTS

| | | |
|---|---|---|
| EP | 2484861 A2 | 8/2012 |
| FR | 3105041 A1 | 6/2021 |

(Continued)

OTHER PUBLICATIONS

International Search Report and Written Opinion issued in International Patent Application No. PCT/US2020/029055 dated Jul. 20, 2020; 15 pages.

(Continued)

*Primary Examiner* — Umashankar Venkatesan
(74) *Attorney, Agent, or Firm* — Kelly McKinney

(57) ABSTRACT

A blowout preventer (BOP) includes a main body that includes a bore extending through the main body. The BOP also includes a cavity intersecting the bore and a pair of opposing shear rams configured to shear a tubular located in the bore. The opposing shear rams are two duplicate shear rams.

18 Claims, 7 Drawing Sheets

(56) References Cited

U.S. PATENT DOCUMENTS

| | | | | |
|---|---|---|---|---|
| 7,367,396 | B2 | 5/2008 | Springett et al. | |
| 7,814,979 | B2 | 10/2010 | Springett et al. | |
| 8,066,070 | B2 * | 11/2011 | Springett | E21B 33/063 166/298 |
| 8,162,046 | B2 * | 4/2012 | Jahnke | E21B 33/063 166/85.4 |
| 8,167,031 | B2 | 5/2012 | Jahnke | |
| 8,353,338 | B2 * | 1/2013 | Edwards | F16K 3/029 166/85.4 |
| 8,424,607 | B2 | 4/2013 | Springett et al. | |
| 8,443,879 | B2 | 5/2013 | Jahnke | |
| 8,443,880 | B1 | 5/2013 | Jahnke | |
| 8,464,785 | B2 | 6/2013 | Carbaugh et al. | |
| 8,505,870 | B2 | 8/2013 | Yadav et al. | |
| 8,567,490 | B2 | 10/2013 | Van Winkle | |
| 8,602,102 | B2 | 12/2013 | Springett et al. | |
| 8,632,047 | B2 | 1/2014 | Hall et al. | |
| 8,720,564 | B2 | 5/2014 | Springett et al. | |
| 8,720,565 | B2 | 5/2014 | Springett et al. | |
| 8,720,567 | B2 | 5/2014 | Springett et al. | |
| 8,770,274 | B2 | 7/2014 | Van Winkle | |
| 8,800,954 | B2 | 8/2014 | Edwards | |
| 8,807,219 | B2 | 8/2014 | Springett et al. | |
| 9,022,104 | B2 | 5/2015 | Springett et al. | |
| 9,133,680 | B2 | 9/2015 | Edwards | |
| 9,644,444 | B2 | 5/2017 | Jurena | |
| 9,732,576 | B2 | 8/2017 | Rao et al. | |
| 9,739,109 | B2 | 8/2017 | Kroesen | |
| 9,822,602 | B2 | 11/2017 | Bleck et al. | |
| 9,879,498 | B2 | 1/2018 | Holland, Jr. | |
| 10,443,336 | B2 | 10/2019 | Ellison | |
| 10,550,660 | B2 | 2/2020 | Carbaugh et al. | |
| 2007/0246215 | A1 | 10/2007 | Springett et al. | |
| 2011/0226476 | A1 | 9/2011 | Springett et al. | |
| 2012/0073816 | A1 | 3/2012 | Springett et al. | |
| 2012/0193556 | A1 | 8/2012 | Yadav et al. | |
| 2013/0119283 | A1 | 5/2013 | Jahnke | |
| 2013/0153204 | A1 * | 6/2013 | Carbaugh | E21B 33/063 166/55 |
| 2016/0138356 | A1 | 5/2016 | Ellison | |
| 2016/0258238 | A1 | 9/2016 | Vargas et al. | |
| 2016/0298409 | A1 | 10/2016 | Kroesen et al. | |
| 2016/0312564 | A1 | 10/2016 | Holland, Jr. | |
| 2017/0058628 | A1 | 3/2017 | van Wijk et al. | |

FOREIGN PATENT DOCUMENTS

| | | | |
|---|---|---|---|
| WO | 2020169714 | A1 | 8/2020 |
| WO | 2020219410 | A1 | 10/2020 |
| WO | 2020219412 | A1 | 10/2020 |

OTHER PUBLICATIONS

International Search Report and Written Opinion issued in International Patent Application No. PCT/US2020/015787 dated May 27, 2020; 16 pages.

* cited by examiner

BLOWOUT PREVENTER SHEARING RAM

CROSS-REFERENCE TO RELATED APPLICATION

This application claims priority to and the benefit of U.S. Provisional Patent Application No. 62/836,696, entitled "Blowout Preventer Shearing Rain" and filed Apr. 21, 2019, which is hereby incorporated by reference it its entirety for all purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be noted that these statements are to be read in this light, and not as admissions of prior art.

In order to meet consumer and industrial demand for natural resources, companies invest significant amounts of time and money in finding and extracting oil, natural gas, and other subterranean resources from the earth. Particularly, once a desired subterranean resource, such as oil or natural gas, is discovered, drilling and production systems are employed to access and extract the resource. These systems may be located onshore or offshore depending on the location of the resource. Such systems generally include a wellhead assembly through which the resource is extracted. These wellhead assemblies may include a wide variety of components, such as various casings, valves, fluid conduits, and the like, that control drilling or extraction operations.

BRIEF DESCRIPTION OF THE DRAWINGS

Various features, aspects, and advantages of the present disclosure will become better understood when the following detailed description is read with reference to the accompanying figures in which like characters represent like parts throughout the figures, in which.

DETAILED DESCRIPTION OF THE DISCLOSED EMBODIMENTS

Figure 1:
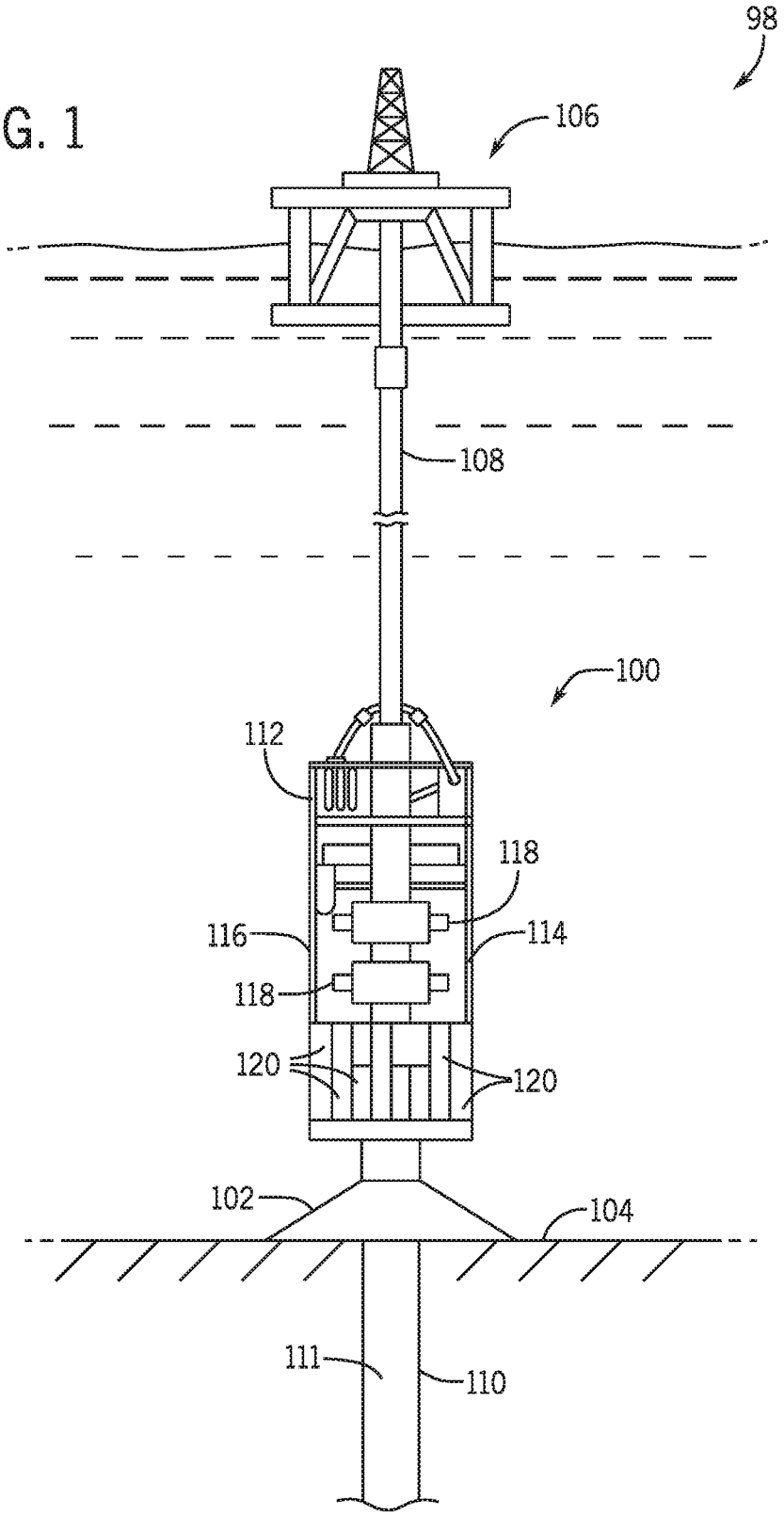
FIG. 1 is a schematic diagram of a drilling system having a blowout preventer (BOP) stack assembly, in accordance with various embodiments of the present disclosure.

The following discussion is directed to various embodiments of the present disclosure. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus, should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components. Numerical terms, such as "first," "second," and "third" are used to distinguish components to facilitate discussion, and it should be appreciated that the numerical terms may be used differently or assigned to different elements in the claims.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

The present disclosure is directed to a drilling system configured to access resources in the earth. The drilling system may suspend a tubular (e.g., drill string) through a wellbore in a field (e.g., a hydrocarbon field) to access the resources. The drilling system may include a wellhead assembly configured to control fluid flow (e.g., formation fluid, drilling fluid) through an annulus formed between the tubular and a casing that lines the wellbore. The wellhead assembly may include a blowout preventer (BOP) that may control pressure and either allow or block fluid flow across the BOP. For example, the BOP may be actuated to seal the annulus during rapid buildup of pressure or fluid flow within the annulus, thereby blocking the fluid flow through the BOP and the wellhead assembly to protect drilling equipment positioned above the BOP.

In some embodiments, the BOP may be a ram-type BOP that includes rams (e.g., shear rams) that are operated (e.g., hydraulically actuated, electromechanically actuated) to shear the tubular contained within a bore of the BOP and, in some cases, to seal the wellbore. The rams may be driven into and out of the bore of the BOP via operating pistons that are coupled, via ram shafts, to ram blocks. The rams may be grouped in opposing pairs, and opposing rams may be forced together to engage and shear the tubular. Upon shearing the tubular, the opposing rams may engage one another to seal the wellbore, thereby blocking the fluid flow through the wellbore (e.g., through the bore of the BOP).

Embodiments of the present disclosure include opposing rams having the same (e.g., the same or substantially the same, such as substantially the same due to manufacturing tolerances, duplicate) geometry (e.g., profile). For example, the opposing (e.g., duplicate) rams may have identical (e.g., identical or substantially identical) profiles and are positioned to axially oppose one another to enable the rams to shear the tubular, engage one another, and seal the wellbore. Thus, there is no distinction between the opposing rams after manufacture and prior to installation. Furthermore, after installation, the only distinction is the orientation of the opposing rams to enable the opposing rams to engage one another. Thus, a single embodiment of a ram may be manufactured and implemented in the BOP. Accordingly, multiple different embodiments of rams are not manufactured and installed (e.g., for a particular one of the opposing pair of rams), thereby reducing a cost associated with manufacture, installation, and/or maintenance of the BOP.

Certain aspects of some embodiments disclosed herein are set forth below. It should be noted that these aspects are presented merely to provide the reader with a brief summary of certain forms the disclosure might take and that these aspects are not intended to limit the scope of the disclosure. Indeed, the disclosure may encompass a variety of aspects that may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

Turning now to the drawings, FIG. 1 is a schematic diagram of an embodiment of a drilling system 98 (e.g., a subsea hydrocarbon drilling system) having a blowout preventer (BOP) stack assembly 100 assembled onto a wellhead assembly 102 on a sea floor 104. The BOP stack assembly 100 is connected in line between the wellhead assembly 102 and a floating rig 106 through subsea riser 108. The BOP stack assembly 100 provides pressure control of drilling/formation fluid in a wellbore 110, which is engaged by a tubular 111 (e.g., drill string) of the drilling system 98 extending through the BOP stack assembly 100. For example, the BOP stack assembly 100 may be operated to mitigate a sudden surge of pressurized fluid flow within the wellbore 110. The BOP stack assembly 100 thus protects the floating rig 106 and the subsea riser 108 from fluid exiting the wellbore 110.

The BOP stack assembly 100 may include a lower marine riser package 112 that connects the subsea riser 108 to a BOP stack package 114. The BOP stack package 114 may also include a frame 116, BOPs 118, and accumulators 120 that may be used to provide backup hydraulic fluid pressure for actuating the BOPs 118. The BOPs 118 may include multiple types of rams that are each designed to seal the wellbore 110 in a different manner. For example, the BOPs 118 may include a ram-type BOP having shear rams to shear the tubular 111, a ram-type BOP having blind rams to seal a hollow section of the wellbore 110, a ram-type BOP having pipe rams, and/or an annular BOP having an annular sealing element to seal the wellbore 110 around the tubular 111, other suitable rams, or any combination thereof. When a pressure surge is detected in the wellbore 110, some or all of the BOPs 118 may be activated to seal the wellbore 110 to block the impact of the pressure surge on other drilling equipment, such as equipment above the BOP stack assembly 100 (e.g., the subsea riser 108).

Figure 2:
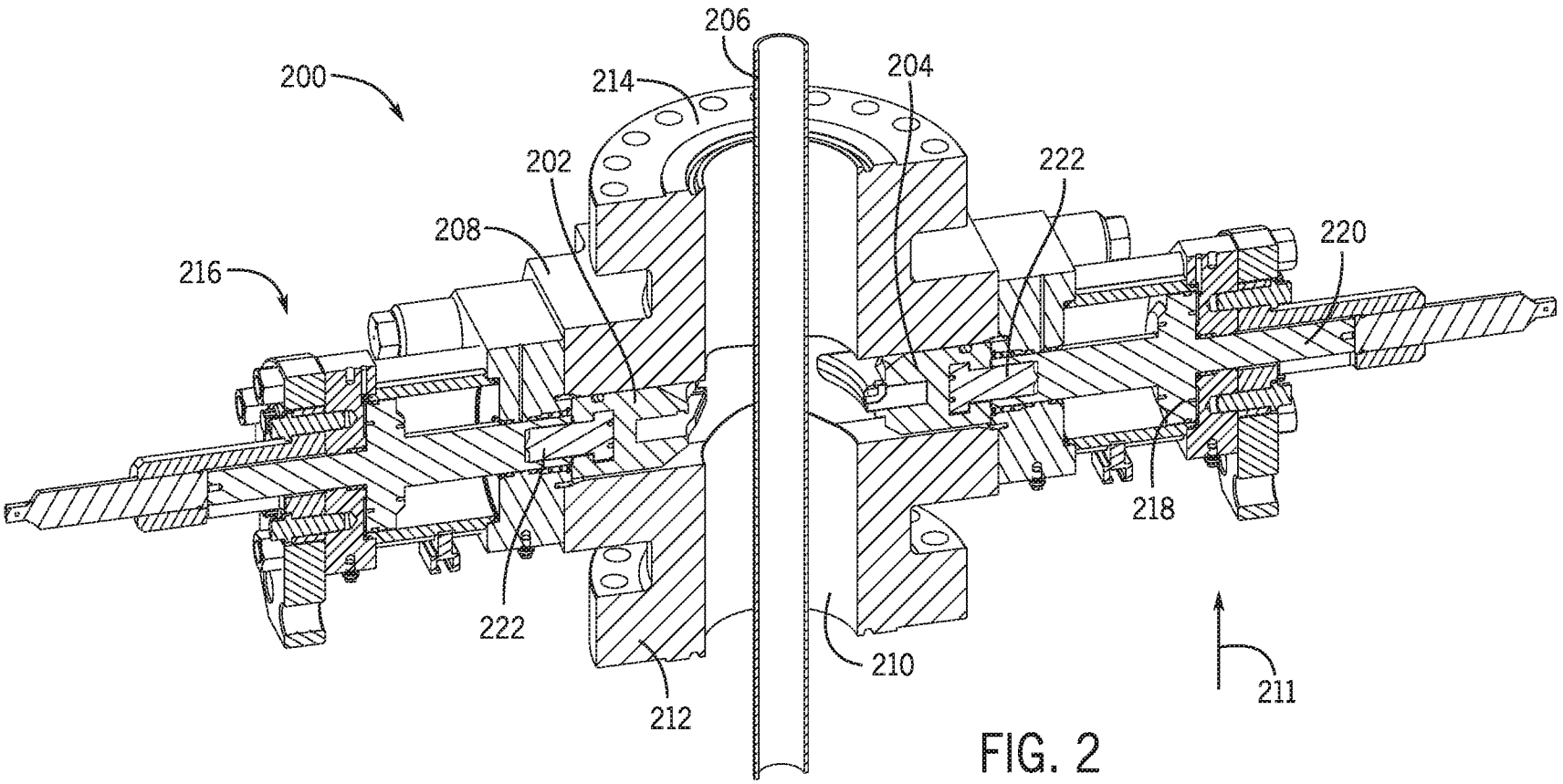
FIG. 2 is a cross-sectional perspective view of a BOP that may be used in the BOP stack assembly of FIG. 1, in accordance with various embodiments of the present disclosure.

FIG. 2 is a cross-sectional perspective view of an embodiment of a BOP 200, which may be a shear ram-type BOP. The BOP 200 may be included in a blowout preventer stack assembly, such as the BOP stack assembly 100 illustrated in FIG. 1. The BOP 200 includes a pair of opposing rams 202, 204 (e.g., axially opposed shear rams). The rams 202, 204 may be actuated (e.g., hydraulically, electromechanically) to be driven together. When driven together, the rams 202, 204 may shear a tubular 206 (e.g., a drill string, a tool joint, a drill collar, a production tubular, hard-banded pipe, casing tubular) that extends through a wellbore between the rams 202, 204. For example, the BOP 200 includes a hollow (e.g., partially hollow) main body 208 having a bore 210 (e.g., a main bore, a central bore) that allows fluids (e.g., drilling fluids, completion fluids, treating fluids, produced fluids) or devices (e.g., the tubular 206) to pass through the BOP 200, such as along a vertical axis 211. The depicted BOP 200 may be mounted on a wellhead or another component by way of a lower connection 212 and/or an upper connection 214. In some embodiments, additional equipment (e.g., a subsea connector, a mandrel for connection to a lower marine riser package) may be installed on the BOP 200 via the upper connection 214 of the blowout preventer 200. In additional or alternative embodiments, the depicted BOP 200 may be one of several BOPs contained within the BOP stack assembly 100, and a respective BOP may be coupled to the BOP 200 via the lower connection 212 and/or the upper connection 214.

The BOP 200 may include bonnet or actuation assemblies 216 secured to the main body 208. The bonnet assemblies 216 may include various components that facilitate control and adjustment of the rams 202, 204 disposed in ram cavities 222 of the main body 208. Each bonnet assembly 216 may include a piston 218 coupled to a ram shaft 220. During operation, a force (e.g., a mechanical force, a hydraulic pressure) may be applied to the pistons 218 to drive (e.g., translate) the rams 202, 204, via the ram shafts 220 and within the respective ram cavities 222, toward one another into the bore 210 of the BOP 200. By driving the rams 202, 204 toward one another, the rams 202, 204 may impart a force onto the tubular 206 to shear the tubular 206. After the rams 202, 204 shear the tubular 206, the pistons 218 may continue to drive the rams 202, 204 into the bore 210 to engage one another and seal the bore 210, thereby inhibiting fluid flow through the BOP 200 and protecting equipment positioned above the main body 208 along the vertical axis 211.

Figure 3:
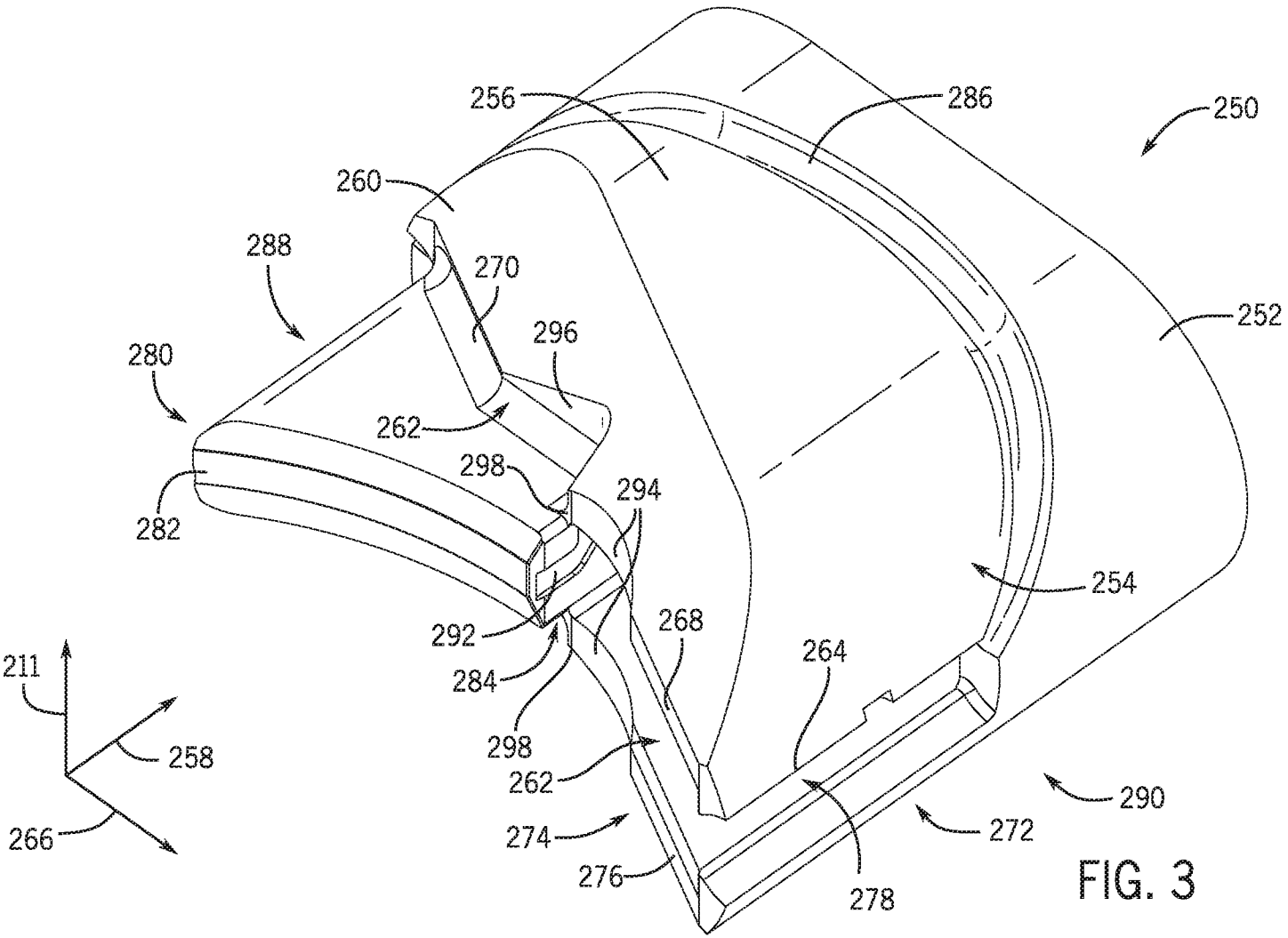
FIG. 3 is a perspective view of a ram that may be used in the BOP of FIG. 2, in accordance with various embodiments of the present disclosure.

As described above, the rams 202, 204 may have substantially the same profile, such as to facilitate manufacturing, installation, maintenance, and the like. FIG. 3 is a perspective view of an embodiment of a ram 250 (a shear ram) that may be used in a BOP, such as the BOP 200 of FIG. 2. That is, the embodiment of the ram 250 may be used as each of the opposing rams 202, 204 of the BOP 200. The illustrated ram 250 may include a body 252, which may be coupled to a ram shaft (e.g., the ram shaft 220) to enable adjustment of the ram 250 (e.g., positioning of the ram 250 within a ram cavity). The body 252 includes a substantially oblong shape in the illustrated example, but the body 252 may include any suitable shape in additional or alternative embodiments.

A first blade section 254 (e.g., a top blade section) may extend from the body 252. For example, a first surface 256 of the first blade section 254 extends away from the body 252 along a longitudinal axis 258. A sloped surface 260 may extend from the first surface 256 at an angle along the vertical axis 211 (e.g., sloped or tapered such that a first vertical edge of the sloped surface 260 positioned proximate to a medial portion of the ram 250 along the vertical axis 211 is closer to the bore of the BOP, and a second vertical edge of the sloped surface 260 positioned distal from the medial portion of the ram 250 along the vertical axis 211 is farther from the bore of the BOP when the ram 250 installed within the main body of the BOP). The sloped surface 260 may provide clearance for the tubular after the tubular is sheared, for example.

On one lateral side of a central, longitudinally-extending axis that extends through a center of the ram 250, the sloped surface 260 may terminate to form a first blade surface 262. The illustrated first blade surface 262 is generally oriented at an acute angle relative to the longitudinal axis 258 (e.g., sloped or tapered such that a first laterally-outer edge of the first blade surface 262 is positioned closer to the bore of the BOP, and a second laterally-outer edge of the first blade surface 262 is positioned farther from the bore of the BOP when the ram 250 is installed within the main body of the BOP). That is, the first blade surface 262 extends crosswise relative to both the longitudinal axis 258 and a lateral axis 266, and a lateral edge 264 of the first blade section 254 is configured to be positioned closer to the bore of the BOP when the ram 250 is installed within the main body of the BOP. In this way, a first portion 268 (e.g., a first straight portion) of the first blade surface 262 on the one lateral side of the central, longitudinally-extending axis may extend farther away from the body 252 along the longitudinal axis 258 than a second portion 270 (e.g., a second straight portion) of the first blade surface 262 on the other lateral side of the central, longitudinally-extending axis.

A second blade section 272 (e.g., a bottom blade section) may extend from the body 252 below the first blade section 254 along the vertical axis 211. The second blade section 272 may have a profile that substantially matches with the profile of the first blade section 254. For example, the second blade section 272 may include a corresponding surface extending from the body 252 and a corresponding sloped surface that slopes to form a second blade surface 274. The second blade surface 274 may generally extend at an acute angle relative to the longitudinal axis 258 (e.g., an acute angle that is substantially the same as the acute angle between the first blade surface 262 and the longitudinal axis 258) to form a third portion 276 (e.g., a third straight portion) of the second blade surface 274. The third portion 276 of the second blade surface 274 and the first portion 268 of the first blade surface 262 may be aligned with one another (e.g., parallel to one another, stacked vertically above one another). The first portion 268 and the third portion 276 may also be spaced apart or offset from one another along the vertical axis 211 to form a space or pocket 278 between the first portion 268 and the third portion 276.

A third blade section 280 (e.g., an intermediate blade section) may extend from the body 252 between the first blade section 254 and the second blade section 272 along the vertical axis 211. The third blade section 280 may be positioned on the other lateral side of the central, longitudinally-extending axis and may be offset from the space 278 and from the first and third portions 268, 276 along the lateral axis 266. For example, the third blade section 280 may extend along the longitudinal axis 258 from underneath the second portion 270 of the first blade section 254 along the vertical axis 211. The third blade section 280 may terminate to form a third blade surface 282 that may have a substantially curved profile (e.g., the third blade surface 282 does not have substantially straight portions). For instance, the third blade surface 282 is continuously curved between a laterally-outer edge and a laterally-inner edge such that the laterally-outer edge of the third blade surface 282 is positioned closer to the bore of the BOP along the longitudinal axis 258 and the laterally-inner edge of the third blade surface 282 is positioned farther from the bore of the BOP along the longitudinal axis 258 when the ram 250 is installed within the main body of the BOP) to facilitate shearing a circular tubular. That is, the curved profile of the third blade surface 282 may enable the third blade section 280 to capture and therefore impart a force on multiple parts or areas of the tubular (e.g., a circular tubular) during engagement. The third blade section 280 may also include a first inner blade surface 284 (e.g., a longitudinally-extending surface, a laterally-facing surface) that faces the space 278. That is, the first inner blade surface 284 may extend along the longitudinal axis 258 and along the space 278.

During engagement between the ram 250 and an opposing ram having a substantially identical geometry, the space 278 of the ram 250 may receive a corresponding third blade section 280 of the opposing ram. Similarly, the third blade section 280 of the ram 250 may extend into the corresponding space 278 of the opposing ram. As such, the third blade section 280 of each ram may overlap with the first and second blade sections 254, 272 of the other ram, thereby blocking fluid flow through the engaged rams and sealing the wellbore.

Furthermore, various grooves may be formed in the ram 250, and each groove may receive a seal element (e.g., an elastomer seal element) that further blocks unwanted fluid flow across the ram 250. By way of example, a first groove 286 may be formed between the first surface 256 and the body 252. The first groove 286 may extend across the ram 250 from a first lateral side 288 to a second lateral side 290 of the ram 250. Thus, a seal element positioned within the first groove 286 may substantially block fluid flow across the first surface 256, across the first lateral side 288, and/or across the second lateral side 290 of the ram 250. For example, the seal element may block fluid flow into the ram cavity and the actuation or bonnet assemblies. Furthermore, a second groove 292 may be formed along surfaces of the ram 250 facing the space 278. For example, the second groove 292 may extend from the first inner blade surface 284 of the third blade section 280 along an inner (e.g., bottom) surface of the first blade section 254 to the lateral edge 264.

A seal element inserted within the second groove 292 may block fluid flow through the space 278. For instance, when the ram 250 is engaged with an opposing ram, the seal element may engage a corresponding third blade section 280 of the opposing ram to block fluid flow across the third blade section 280 within the space 278. In this way, the seal element blocks fluid flow through the space 278, thereby blocking fluid flowing between the rams (e.g., in an upward direction along the vertical axis 211). In addition, the seal element (e.g., a portion of the seal adjacent to the lateral edge 264) may block fluid flow across the first surface 256 along the second lateral side 290 to block fluid flow through the ram cavity. In some embodiments, each seal element may include a material, such as a polymeric (e.g., rubber) material that induces sufficient rubber pressure during engagement to block fluid flow. Further, it should be noted that additional or alternative grooves may be formed in the ram 250 to enable seal elements to be positioned in various manners to block fluid flow during engagement of the ram 250 with the opposing ram.

In certain embodiments, each of the first and second blade sections 254, 272 may include a respective recess 294 (e.g., a cur weed recess) formed on the first blade surface 262 adjacent to the first portion 268 or on the second blade surface 274 adjacent to the third portion 276. The recesses 294 may be aligned with one another (e.g., stacked vertically above one another) and may facilitate maintaining a desirable position of the tubular during engagement of the ram 250 with the opposing ram. For example, the recesses 294 may be shaped to position the tubular in a manner that facilitates engagement with the third blade section 280, thereby enabling the third blade section 280 to effectively shear the drill component. In the illustrated embodiment, the recesses 294 may include a circular shape positioned adjacent to a center of the first and second blade surfaces 262, 274, respectively. Thus, the illustrated recesses 294 may facilitate centering a circular tubular to enable the third blade sections 280 to shear the tubular. However, additional or alternative recesses 294 may have any suitable shape, or the recesses 294 may be omitted. In any case, the angle at which the first and the second blade surfaces 262, 274 are oriented relative to the longitudinal axis 258 may guide the tubular (e.g., an off-center tubular) toward the recesses 294 and/or toward a center of the ram 250, and the recesses 294 may maintain the tubular centered along the ram 250 (e.g., along the lateral axis 266) as the third blade section 280 engages the drill component. In this manner, the first and second blade sections 254, 272 may be support sections that substantially hold the position of the tubular as the third blade sections 280, which may be cutting blades having a knife or cutting edge, impose a force to shear the tubular.

Additionally, a respective notch 296 may be formed onto the first and second blade surfaces 262, 274. Each notch 296 may extend from the respective recesses 294 toward the first lateral side 288. Thus, for example, the notch 296 formed in the first blade surface 262 may extend from the recess 294 of the first blade surface 262 to the second portion 270 of the first blade surface 262. In this manner, each notch 296 may overlap with the third blade section 280 along the lateral axis 266 (e.g., stacked vertically along the third blade section 280). That is, the first portion 268 of the first blade surface 262, the third portion 276 of the second blade surface 274, and the recesses 294 may occupy a first lateral half of the ram 250, and the second portion 270 of the first blade surface 262, the notch 296, and the third blade section 280 may occupy a second lateral half of the ram 250. The profiles of the notches 296 may form respective edges 298 between the recesses 294 and the notches 296. The edges 298 may further facilitate shearing of the tubular. By way of example, the edges 298 may impart additional forces onto the tubular.

Figure 4:
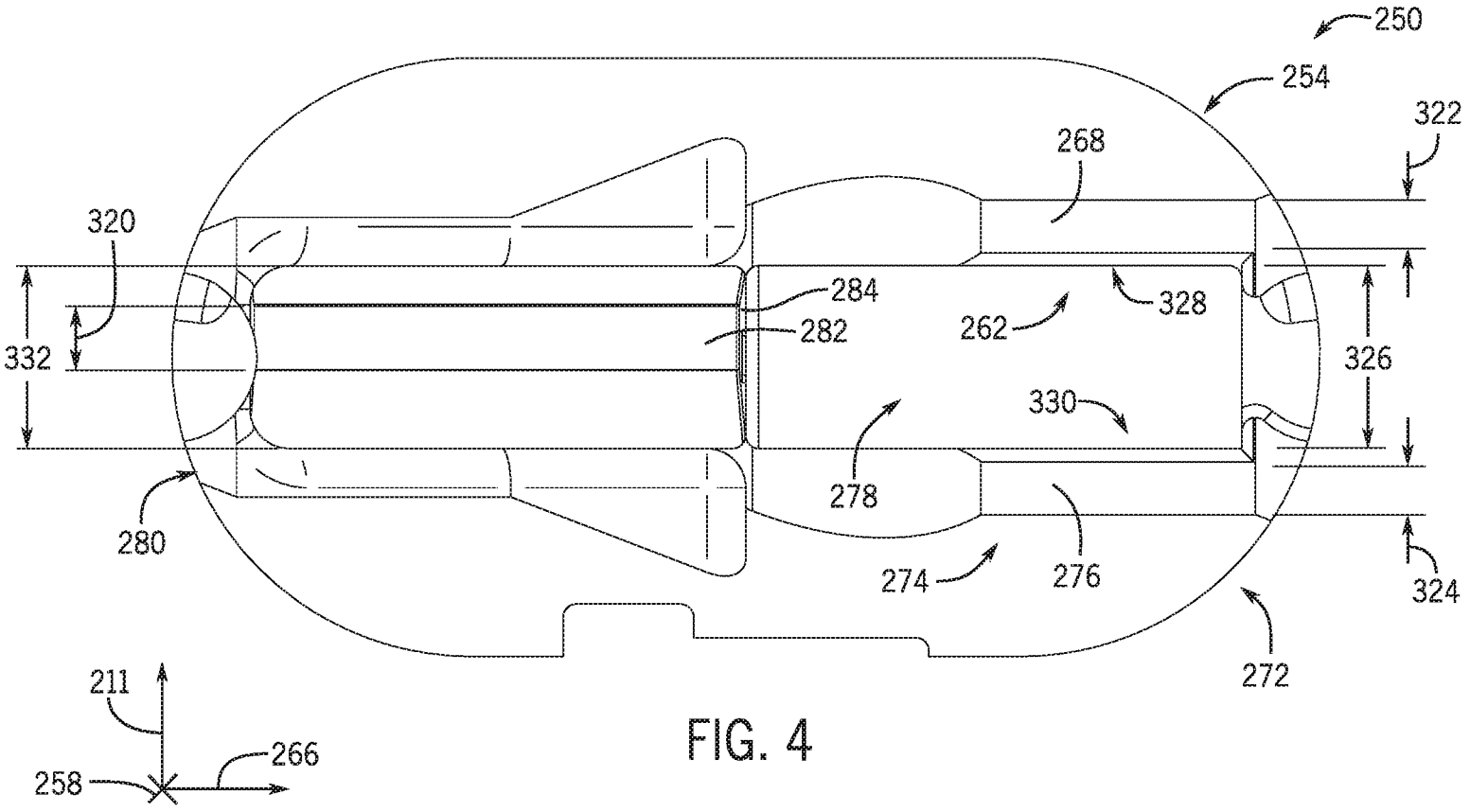
FIG. 4 is a front view of the ram of FIG. 3, in accordance with various embodiments of the present disclosure.

FIG. 4 is a front view of the ram 250 of FIG. 3. In the illustrated embodiment, the third blade surface 282 has a first thickness 320 that is sized to facilitate imparting a shear force onto the tubular during engagement of the ram 250 with the opposing ram. Further, the first portion 268 of the first blade surface 262 and the third portion 276 of the second blade surface 274 include a second thickness 322 and a third thickness 324, respectively. In some embodiments, the first thickness 320, the second thickness 322, and/or the third thickness 324 may all be equal (e.g., equal or substantially equal) to one another. As such, the first portion 268 and/or the third portion 276 may also be sized to impart a shear force onto the tubular during engagement of the ram 250 with the opposing ram. By way of example, for tubulars having a particular geometry (e.g., a large diameter), the first portion 268 of the first blade surface 262, the second portion 272 of the second blade surface 274, and/or the third blade surface 282 may simultaneously (e.g., simultaneously and/or substantially simultaneously) contact and/or engage a respective portion of the tubular to shear the tubular.

In addition, a distance 326 may span between a second inner blade surface 328 (e.g., a bottom surface, a vertically-facing surface) of the first blade section 254 and a third inner blade surface 330 (e.g., a top surface, a vertically-facing surface) of the second blade section 272. Thus, the space 278 may have a height spanning the distance 326. The distance 326 may accommodate (e.g., be substantially equal to) a fourth thickness 332 of the third blade section 280. For instance, during engagement of the ram 250 with an opposing ram, one or more of the surfaces (e.g., a top surface and a bottom surface, vertically-facing surfaces) of the third blade section 280 of the opposing ram may respectively engage (e.g., contact, abut) the first inner blade surface 284 of the third blade section 280, the second inner blade surface 328 of the first blade section 254, and/or the third inner blade surface 330 of the second blade section 272, thereby blocking fluid flow through the space 278. As noted above, one or more sealing elements may be positioned along one or more of these inner surfaces 284, 328, 330, and thus, it should be noted that the contact between the inner surfaces 284, 328, 330 may include contact between the one or more sealing elements with one or more of these inner surfaces 284, 328, 330.

Figure 5:
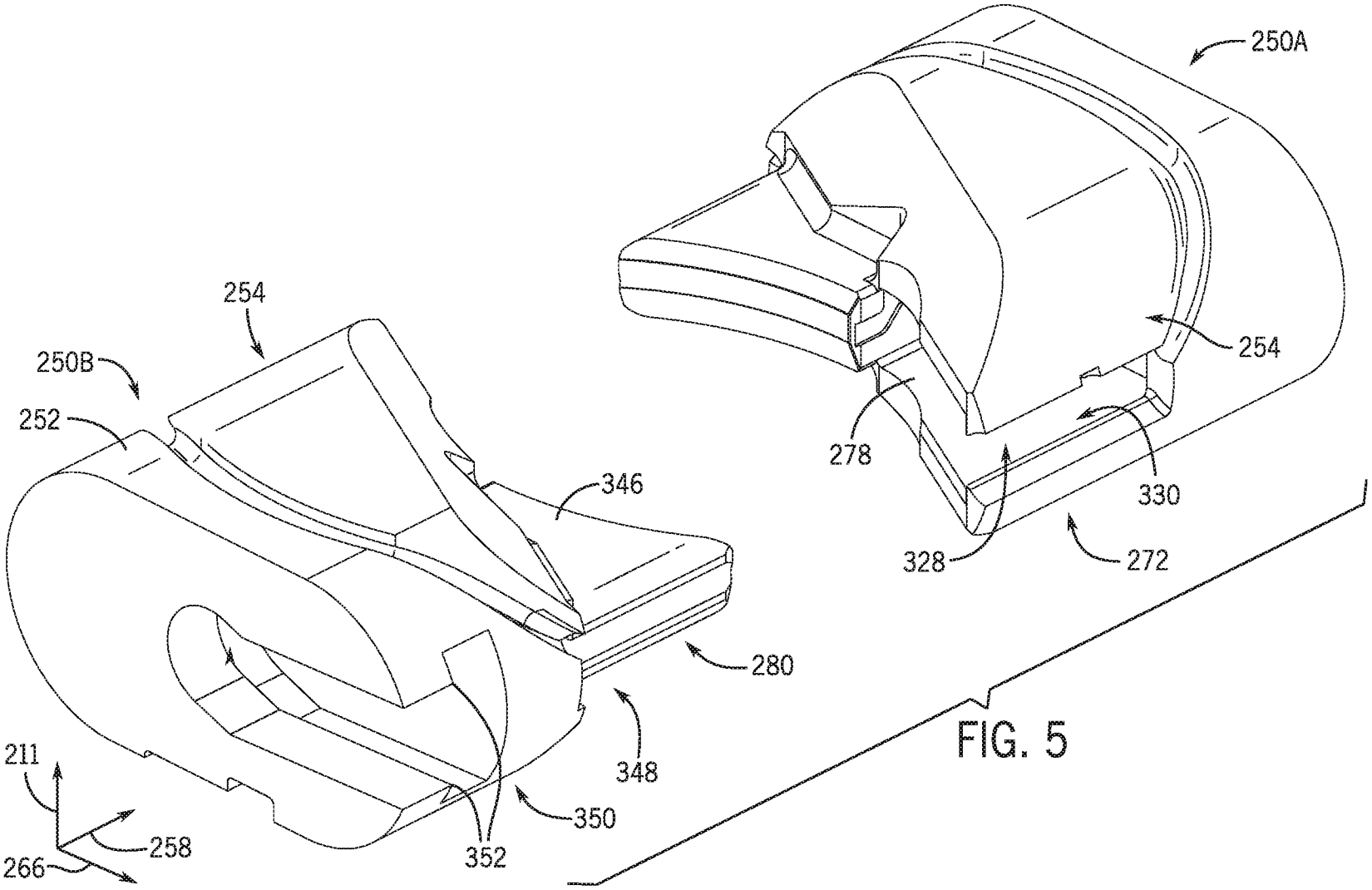
FIG. 5 is a perspective view of opposing rams that have substantially identical profiles and that may be used in the BOP of FIG. 2, in accordance with various embodiments of the present disclosure.

FIG. 5 is a perspective view of an embodiment of opposing rams 250 in a disengaged configuration. As illustrated, a first ram 250A may have a substantially similar geometry as a second ram 250B, and the rams 250 may be oriented such that the profiles of the rams 250 axially oppose one another. As used herein, axially oppose refers to an arrangement of the first ram 250A relative to the second ram 250B in which the first ram 250A is rotated 180 degrees about the vertical axis 211 relative to the second ram 250B. Moreover, the first ram 250A and the second ram 250B may each be aligned opposite one another such that each third blade section 280 is aligned with an opposing space 278 (e.g., relative to the longitudinal axis 258). In other words, the third blade section 280 of one of the rams 250 is positioned opposite the first blade section 254, the second blade section 272, and the space 278 of an opposing ram. Moreover, the third blade sections 280 may be generally coplanar to one another. Thus, during actuation of the rams 250 to drive the rams 250 toward one another along the longitudinal axis 258, the respective spaces 278 may receive (e.g., sheath) an opposing third blade section 280, thereby filling the spaces 278 and blocking fluid from flowing between the engaged rams 250. By way of example, in the engaged configuration, a second surface 346 (e.g., a top surface) of the third blade section 280 may engage (e.g., abut) the second inner blade surface 328 of the first blade section 254 and/or a third surface 348 (e.g., a bottom surface) of the third blade section 280 opposite the second surface 346 may engage (e.g., contact, abut) the third inner blade surface 330 of the second blade section 272.

Each ram 250 may also include a channel 350 formed through the body 252. The channel 350 may be used for coupling the rams 250 to a corresponding ram shaft. For example, the ram shaft may include a feature that is inserted into the channel 350. In the illustrated embodiment, the channel 350 includes a T-shape to form lips 352. The lips 352 may engage a feature (e.g., a corresponding lip) of the ram shaft to block movement between the ram 250 and the ram shaft along the longitudinal axis 258, thereby maintaining the coupling between the ram 250 and the ram shaft.

Figure 6:
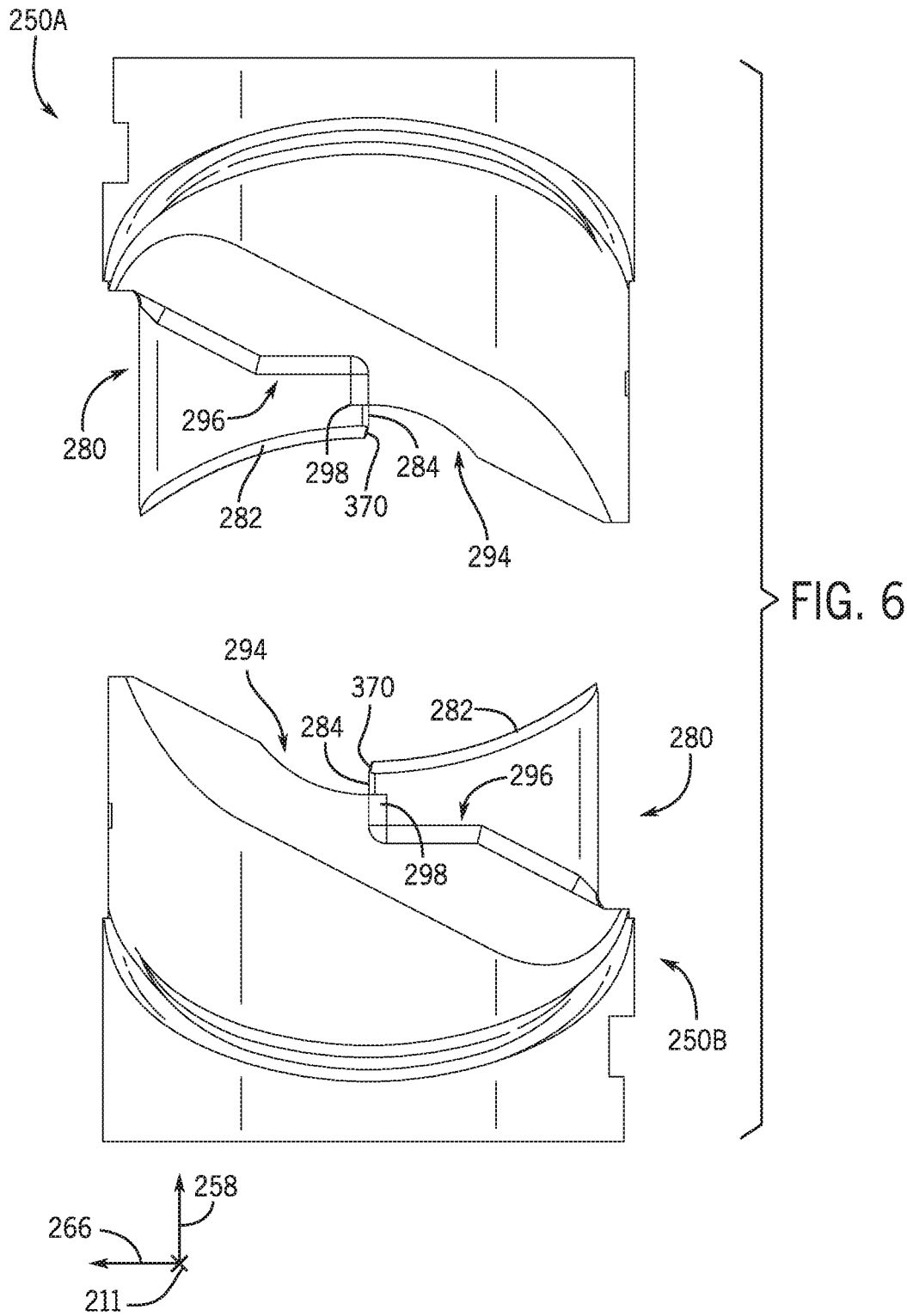
FIG. 6 is a top view of the opposing rams of FIG. 5 in a disengaged configuration, in accordance with various embodiments of the present disclosure.

FIG. 6 is a top view of the opposing rams 250 of FIG. 5. In the illustrated embodiment, the first inner blade surfaces 284 of the opposing third blade sections 280 may be substantially aligned with one another (e.g., only offset slightly along the lateral axis 266). In this way, during engagement between the rams 250, the first inner blade surfaces 284 of the opposing rams 250 may engage (e.g., contact, abut) one another, such as via the sealing elements disposed along the first inner blade surfaces 284, to block fluid flow between the first inner blade surfaces 284. Moreover, in this way, a respective edge 370 of the third blade sections 280 formed from the transition of the third blade surfaces 282 to the first inner blade surfaces 284 may engage opposite sides of the tubular. That is, the edges 370 may collectively impart a compressive force onto opposite sides of the tubular to facilitate shearing of the tubular. Together, the third blade sections 280 extend laterally across the bore (e.g., extend across an entirety of the bore of the BOP along the lateral axis 266) so as to shear the tubular within the bore.

Additionally, such positioning of the rams 250 opposite one another may also position the respective recesses 294 opposite a corresponding notch 296 of the opposing ram 250 along the longitudinal axis 258. In this way, during engagement of the rams 250, the recesses 294 may engage and maintain the positioning of opposite sides of the tubular, and the edges 298 formed by the notches 296 may engage and shear the tubular. That is, as the rams 250 move along the longitudinal axis 258 and engage the tubular, the recesses 294 may drive the tubular toward the opposing notch 296 as the third blade sections 280 engage the tubular, thereby facilitating shearing of the tubular.

Figure 7:
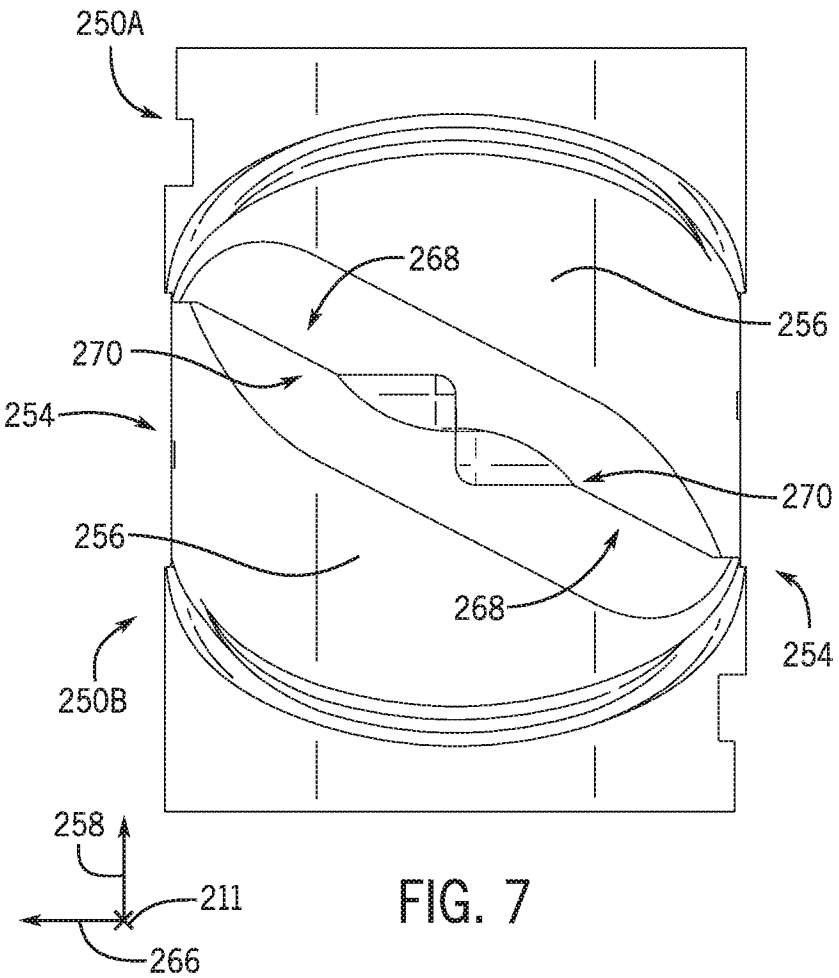
FIG. 7 is a top view of the opposing rams of FIG. 5 in an engaged configuration, in accordance with various embodiments of the present disclosure.

FIG. 7 is a top view of an embodiment of opposing rams 250 in an engaged configuration. In the engaged configuration, the respective third blade sections may be inserted into the opposing spaces between the first and second blade sections. Moreover, in the engaged configuration, the respective first portions 268 of the first blade sections 254 may engage (e.g., contact, abut) a corresponding second portion 270 of the opposing first blade section 254. To this end, the respective first blade sections 254 may be substantially aligned with one another relative to the vertical axis 211. That is, the first surface 256 of the first blade section 254 may be substantially coplanar to the first surface 256 of the first blade section 254 of the opposite ram 250. Therefore, the interface between the opposing first blade sections 254 may substantially block fluid flow between the rams 250 to seal the wellbore.

Figure 8:
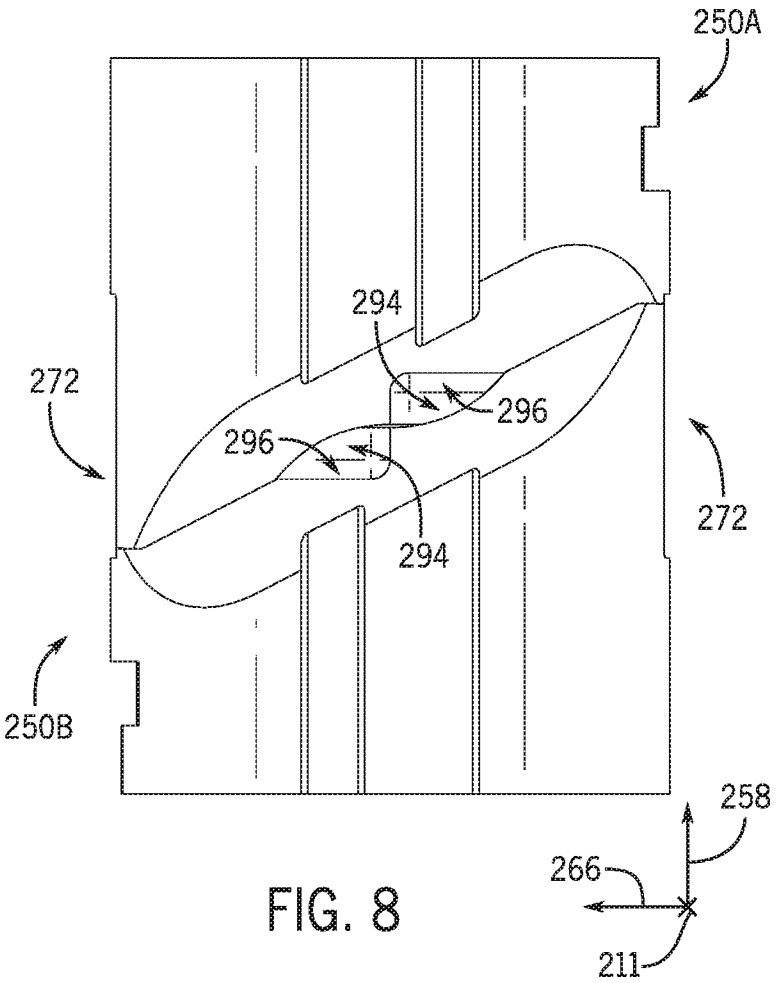
FIG. 8 is a bottom view of the opposing rams of FIG. 5 in the engaged configuration, in accordance with various embodiments of the present disclosure.

FIG. 8 is a bottom view of an embodiment of opposing rams 250 in an engaged configuration. In the engaged configuration, the opposing second blade sections 272 of the rams 250 may engage (e.g., contact, abut) one another, and the interface between the opposing second blade sections 272 may further block fluid flow between the rams 250 to seal the wellbore. Furthermore, in the illustrated embodiment, each second blade section 272 may also include a notch 296 that is positioned opposite the recess 294 of the opposing ram 250 along the longitudinal axis 258. In this way, multiple pairs of recesses 294 and opposing notches 296 may engage the tubular along the vertical axis 211 to facilitate shearing the tubular.

While specific embodiments have been shown and described, modifications can be made by one skilled in the art without departing from the spirit or teaching of this disclosure. The embodiments as described are exemplary only and are not limiting. Many variations and modifications are possible and are within the scope of the disclosure. Accordingly, the scope of protection is not limited to the embodiments described, but is only limited by the claims that follow, the scope of which shall include all equivalents of the subject matter of the claims. While embodiments of the present disclosure include opposing rams having the same geometry, it should be noted that the opposing rams disclosed herein may be modified to include other features such that the opposing rams include the same geometry and/or such that the opposing rams do not include the same geometry (e.g., at least one of the opposing rams includes certain features disclosed herein, such as one or more of the first, second, third blade sections, the sloped surface, the space, or the like, but the opposing rams vary in geometries from one another).

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A blowout preventer (BOP) comprising:

a main body comprising a bore extending therethrough along a vertical axis and a cavity intersecting the bore; and a pair of axially opposed shear rams configured to move through the cavity toward the bore to shear a tubular located in the bore, wherein the pair of axially opposed shear rams are two duplicate shear rams that are aligned with one another relative to the vertical axis, wherein the pair of axially opposed rams comprises: a first shear ram with a first blade section; and a second shear ram with a second blade section, and wherein the first blade section and the second blade section are aligned with one another relative to the vertical axis and together extend across an entirety of the bore along a lateral axis to facilitate shearing of the tubular and sealing of the bore.

2. The BOP of claim 1, wherein the first shear ram further comprises: a first support section having a portion offset from the first blade section along the lateral axis wherein the second blade section is positioned opposite the first support section of the first shear ram along a longitudinal axis, and wherein the second shear ram further comprises: a second support section positioned opposite the first blade section of the first shear ram along the longitudinal axis.

3. The BOP of claim 2, wherein, in an engaged configuration, a first surface of the first blade section of the first shear ram is configured to engage a second surface of the second support section of the second shear ram, and a third surface of the second blade section of the second shear ram is configured to engage a fourth surface of the first support section of the first shear ram.

4. The BOP of claim 2, wherein, in an engaged configuration, a first inner surface of the first blade section of the first shear ram is configured to engage a second inner surface of the second blade section of the second shear ram.

5. The BOP of claim 2, wherein the first support section of the first shear ram comprises a recess adjacent to the portion, wherein the recess is formed to maintain a position of the tubular positioned within the bore of the main body during engagement between the first shear ram and the tubular.

6. The BOP of claim 5, wherein the first support section of the first shear ram comprises a notch extending off the recess to form an edge of the first support section, wherein the edge is configured to facilitate shearing of the tubular during engagement between the first shear ram and the tubular.

7. The BOP of claim 2, wherein, in an engaged configuration, the first blade section is received within a respective pocket of the second support section, and the second blade section is received within a respective pocket of the first support section.

8. The BOP of claim 2, wherein the first blade section occupies a first lateral half of the first shear ram, and the second blade section occupies a second lateral half of the second shear ram.

9. The BOP of claim 2, wherein the first blade section and the second blade section are curved along the lateral axis.

10. A shear ram for a blowout preventer (BOP), the shear ram comprising:

a main body;

a first blade section extending from the main body;

a second blade section extending from the main body, wherein the second blade section is offset from the first blade section along a vertical axis to form a space between the first blade section and the second blade section; and a third blade section positioned between the first blade section and the second blade section along the vertical axis, wherein the third blade section is offset from the space along a lateral axis, wherein a thickness of the third blade section is substantially equal to a height of the space.

11. The shear ram of claim 10, wherein the first blade section comprises a first blade surface oriented at a respective acute angle relative to a longitudinal axis such that a first portion of the first blade section extends farther from the main body than a second portion of the first blade section extends from the main body.

12. The shear ram of claim 11, wherein the second blade section comprises a second blade surface oriented at a respective acute angle relative to the longitudinal axis such that a third portion of the second blade section extends farther from the main body than a fourth portion of the second blade section extends from the main body.

13. The shear ram of claim 12, wherein the space is formed between the first portion of the first blade section and the third portion of the second blade section.

14. The shear ram of claim 10, wherein the third blade section comprises a first inner blade surface facing the space, the first blade section comprises a second inner blade surface facing the space, the shear ram comprises a groove formed across the first inner blade surface and the second inner blade surface to a lateral edge of the first blade section, and the groove is configured to receive a seal element.

15. The shear ram of claim 10, wherein the third blade section comprises a curved profile.

16. A blowout preventer (BOP), comprising:

a first shear ram; and a second shear ram having a substantially identical profile as the first shear ram, wherein the second shear ram is positioned opposite the first shear ram along a longitudinal axis such that the second shear ram axially opposes the first shear ram, wherein the first shear ram and the second shear ram are translatable toward one another to shear a tubular within a bore of the BOP;

wherein each of the first and second shear rams comprises:

a first blade section;

a second blade section offset from the first blade section along a vertical axis to form a space between the first blade section and the second blade section; and a third blade section positioned between the first blade section and the second blade section, wherein the third blade section is offset from the space along a lateral axis such that, in an engaged configuration, the third blade section of the first shear ram is configured to insert into the space of the second shear ram, and the third blade section of the second shear ram is configured to insert into the space of the first shear ram.

17. The BOP of claim 16, wherein the first blade section of each of the first and second shear rams comprises a blade surface, and, in the engaged configuration, the blade surface of the first blade section of the first shear ram is configured to engage the blade surface of the first blade section of the second shear ram.

18. The BOP of claim 17, wherein each of the first and second shear rams comprises:

a first recess formed into the blade surface of the first blade section; and a second recess formed into the blade surface of the second blade section, wherein the first recess and the second recess of the same blade section are stacked along a vertical axis to facilitate maintaining a position of a drill component extending through the BOP during engagement between the drill component with the first shear ram, the second shear ram, or both.

* * * * *